US007304558B1

(12) United States Patent
Pleskach et al.

(10) Patent No.: US 7,304,558 B1
(45) Date of Patent: Dec. 4, 2007

(54) TOROIDAL INDUCTOR DESIGN FOR IMPROVED Q

(75) Inventors: Michael D. Pleskach, Orlando, FL (US); Bayardo A. Payan, Melbourne, FL (US); Terry Provo, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/624,321

(22) Filed: Jan. 18, 2007

(51) Int. Cl.
*H01F 5/00* (2006.01)

(52) U.S. Cl. ..... 336/200; 336/223; 336/232; 29/602.1; 29/606

(58) Field of Classification Search ..... 336/200, 336/223, 232; 29/602.1, 605, 606
See application file for complete search history.

(56) References Cited

U.S. PATENT DOCUMENTS 4,878,291 A * 11/1989 Suguri ..... 29/606
5,055,816 A * 10/1991 Altman et al. ..... 336/200
5,191,699 A * 3/1993 Ganslmeier et al. ..... 29/602.1
5,781,091 A 7/1998 Krone et al.
5,959,846 A * 9/1999 Noguchi et al. ..... 361/782
6,054,914 A 4/2000 Abel et al.
6,148,500 A * 11/2000 Krone et al. ..... 29/602.1
6,198,374 B1 3/2001 Abel
6,820,321 B2 * 11/2004 Harding ..... 29/602.1
6,990,729 B2 1/2006 Pleskach

* cited by examiner

*Primary Examiner*—Anh Mai
(74) *Attorney, Agent, or Firm*—Darby & Darby PC; Robert J. Sacco

(57) ABSTRACT

A toroidal inductor (100) and method of forming same. The invention is intended to decrease the direct current resistance (DCR) of the toroidal inductor circuit. Thus, an increase in the quality factor (Q) of the circuit is produced. The toroidal inductor includes a coil formed from an elongated conductor extending around a core material and defining a plurality of turns. The elongated conductor is comprised of one or more coil segments. The coil segments are arranged in an alternating pattern of a first type segment (101) and a second type segment (102). Each of the coil segments of the first type includes a plurality of elongated parallel conductors (104, 105) spaced apart and electrically connected by conductive links (108) at predetermined intervals along their respective lengths. The coil segments of the second type are formed of a single conductor defined by a conductive via (302, 304) formed in the substrate.

20 Claims, 12 Drawing Sheets

TOROIDAL INDUCTOR DESIGN FOR IMPROVED Q

BACKGROUND

1. Statement of the Technical Field

The inventive arrangements relate generally to inductors and more particularly to toroidal inductors.

2. Description of the Related Art

Embedded toroidal inductors are known in the art. For example, U.S. Pat. No. 6,990,729 to Pleskach et al. discloses a method for forming an embedded toroidal inductor. The method includes the step of forming in a ceramic substrate a first plurality of conductive vias radially spaced a first distance from a central axis so as to define an inner circumference. A second plurality of conductive vias is formed radially spaced a second distance about the central axis so as to define an outer circumference. A first plurality of conductive traces forming an electrical connection between substantially adjacent ones of the first and second plurality of conductive vias is formed on a first surface of the ceramic substrate. Further, a second plurality of conductive traces forming an electrical connection between circumferentially offset ones of the first and second plurality of conductive vias is formed on a second surface of the ceramic substrate opposed from the first surface to define a three dimensional toroidal coil.

In conventional embedded inductor designs of the prior art, there are two components that comprise the toroidal inductor coil conductive traces and conductive vias. Of these two components, the conductive traces account for the vast majority of the direct current resistance (DCR) due to their very small cross sectional area in comparison to the conductive vias. DCR is defined as the resistance of the inductor winding as measured using direct current. Notably, an increase in the value of DCR will cause a decrease in the quality factor (Q) of the inductor.

Since Q is a measure of the relative losses in an inductor, the higher the DCR the lower the Q in the system. In many applications, it is desirable to provide an inductor with very high Q. Therefore, what is needed is an improved toroidal inductor design that can reduce the direct current resistance of the inductor and thereby increase Q. At the same time, the design should not increase the x-y plane size of the toroidal footprint or require any additional machining or post processing steps.

SUMMARY OF THE INVENTION

The invention concerns an inductor and method for forming an inductor. The inductor comprises a coil formed from an elongated conductor extending around a core material and defining a plurality of turns. The elongated conductor includes one or more coil segments of a first type. Each coil segment of the first type is comprised of a plurality of elongated parallel conductors spaced apart and electrically connected by conductive links at predetermined intervals along their respective lengths. Each of the elongated parallel conductors is comprised of a conductive trace disposed on a surface of a substrate. Moreover, the conductive links are formed from vias defined in a substrate.

Further, the inductor is comprised of one or more coil segments of a second type. Each coil segment of the second type is formed of a single conductor. In particular, the single conductor comprising the coil segment of the second type comprises a conductive via formed in a substrate. The coil segment of the first type and the coil segment of the second type are arranged in a series configuration to form the elongated conductor.

According to one aspect of the invention, the elongated conductor is comprised of a plurality of coil segments of the first type and a plurality of coil segments of the second type. Each coil segment of the second type defines a series electrical connection between coil segments of the first type.

According to yet another aspect of the invention, the inductor can include a coil formed from an elongated conductor extending around a core material and defining a plurality of turns. The elongated conductor includes a plurality of coil segments arranged in an alternating pattern of a first type segment and a second type segment. The first type segment comprises a plurality of parallel conductors spaced apart and electrically connected at predetermined intervals along a length of the plurality of parallel conductors. The second type segment comprises a single elongated conductor comprised of conductive vias formed in a substrate. In addition, the conductive traces are connected at the predetermined intervals by one or more conductive vias.

The invention can also comprise a method for forming an inductor. The method includes forming a coil from an elongated conductor extending around a core material to define a plurality of turns. The method also includes the step of forming the elongated conductor to include at least one coil segment of a first type comprised of a plurality of elongated parallel conductors spaced apart. The elongated parallel conductors are electrically connected by means of conductive links spaced at predetermined intervals along a length of the plurality of elongated parallel conductors. Moreover, each of the parallel conductors is formed as a conductive trace disposed on a surface of the substrate. The conductive links are formed from vias defined in a substrate.

The method can also include the step of forming the elongated conductor of at least one coil segment of a second type. The coil segment of the second type is formed of a single conductor. Each coil segment of the second type is formed as a conductive via formed in a substrate. Furthermore, one or more coil segments of the first type and one or more coil segments of the second type are arranged in a series configuration to form the elongated conductor. According to one aspect, the method includes the step of forming with at least one coil segment of the second type a series electrical connection between a plurality of the coil segments of the first type.

According to yet another aspect of the invention, the method can include forming an elongated conductor which extends a plurality of turns around a core material to define a coil. The elongated conductor is selected to include a plurality of coil segments arranged in an alternating pattern of a first type segment and a second type segment. The first type segment is selected to include a plurality of parallel conductors spaced apart and electrically connected to each other at predetermined intervals along a length of the plurality of parallel conductors. The second type segment includes a single conductor. The method further comprises forming the second type segments as conductive vias disposed within a substrate. Moreover, each parallel conductor is formed as a conductive trace disposed on a surface of a substrate. The conductive traces are connected at the predetermined intervals by one or more conductive vias.

DETAILED DESCRIPTION OF THE PREFERRED EMBODIMENTS

The invention concerns an improved toroidal inductor integrated within a ceramic substrate and a method of making same. For convenience, the substrate is described herein as a ceramic substrate. However, it should be understood that the invention is not limited in this regard. Substrates formed of other material can also be used. For example, such materials include, but are not limited to liquid crystal polymer (LCP), polymer film, polyimide film, epoxy laminates, or semiconductor materials such as silicon, gallium arsenide, gallium nitride, germanium or indium phosphide.

Figure 1:
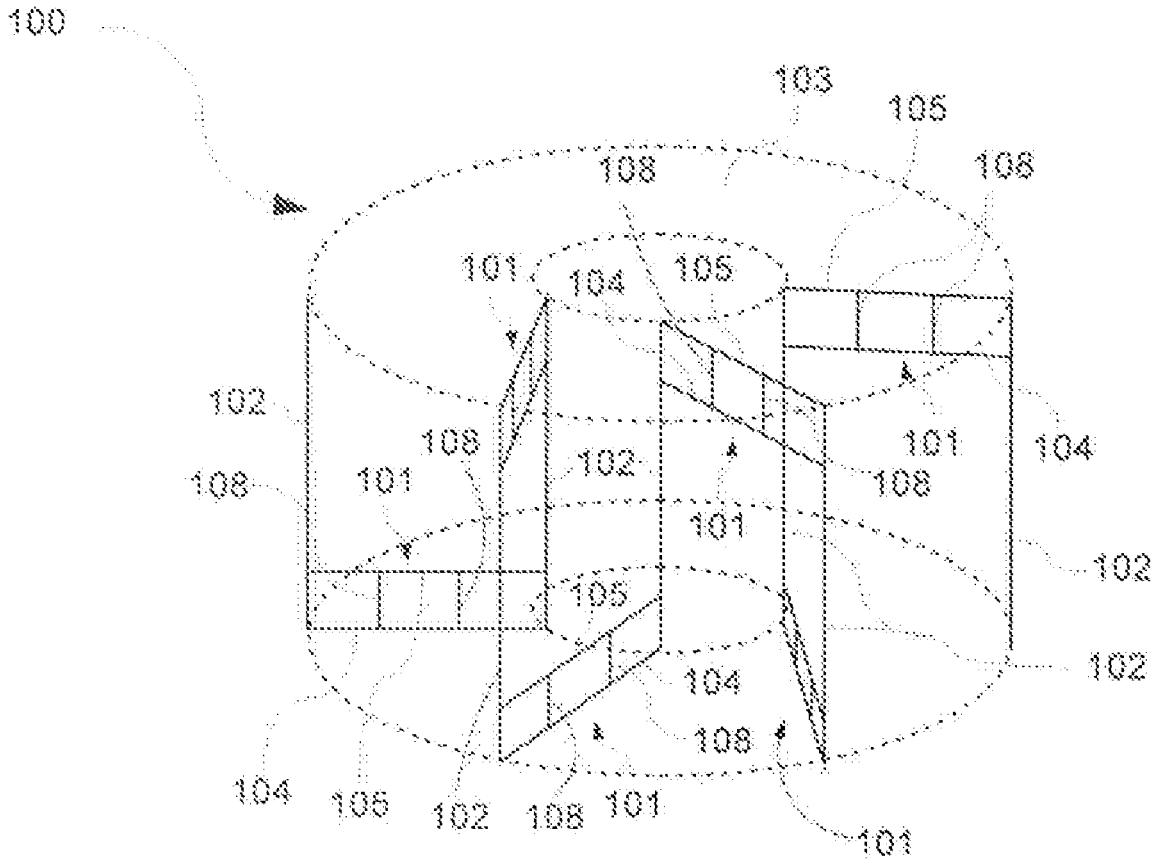
FIG. 1 is a schematic representation that is useful for understanding the structure of an improved toroidal inductor.

Referring to FIG. 1, a schematic representation of the improved toroidal inductor 100 is shown. The inductor 100 comprises a coil formed of an elongated conductor defining a plurality of turns and extending around a core material 103. The improved toroidal coil structure includes a plurality of coil segments arranged in an alternating pattern. The coil segments include a first type coil segment 101 and a second type coil segment 102. The first type coil segment 101 is comprised of a plurality of elongated parallel conductors 104, 105. A first elongated parallel conductor 104 forms a first parallel conductor pair with a second elongated parallel conductor 105. The parallel conductors 104, 105 are spaced apart from each other and electrically connected at locations along their elongated length by at least one first conductive link 108. The second type coil segments 102 provide a series electrical connection between spaced apart ones of the first type coil segment 101.

In a conventional embedded toroidal inductor, a first type coil segment 101 is formed of a single conductive trace disposed on a surface of a substrate. However, such conductive traces have a relatively low cross sectional area. Accordingly, they tend to have a relatively high resistance. In the present invention, this problem is overcome by using a plurality of elongated parallel conductors 104, 105 to decrease the direct current resistance. Conventional embedded toroidal inductors do not make use of separate parallel conductors to form a first type coil segment 101. In the present invention, conductive links 108 are used to minimize the effect of any capacitance that might otherwise exist as between the elongated parallel conductors 104, 105. The second type coil segments 102 can be formed as conductor filled vias using conventional circuit board manufacturing techniques.

Figure 2A:
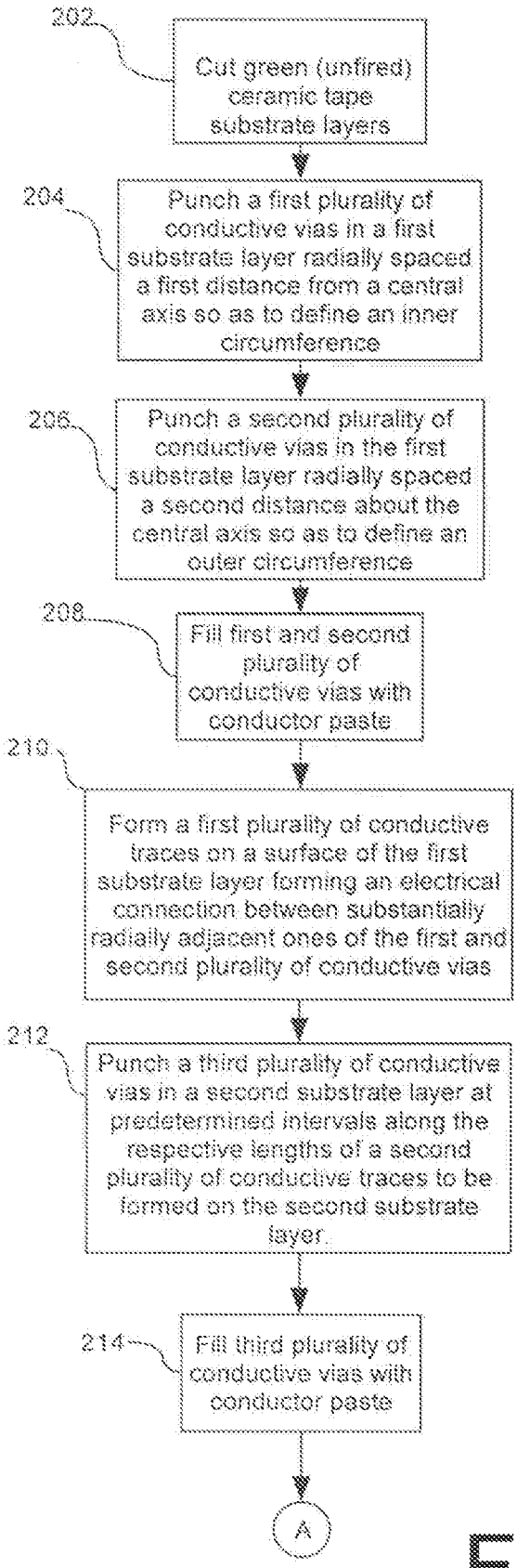
FIGS. 2A and 2B illustrate a flow chart that is useful for understanding the method of making the present invention.
Figure 2B:
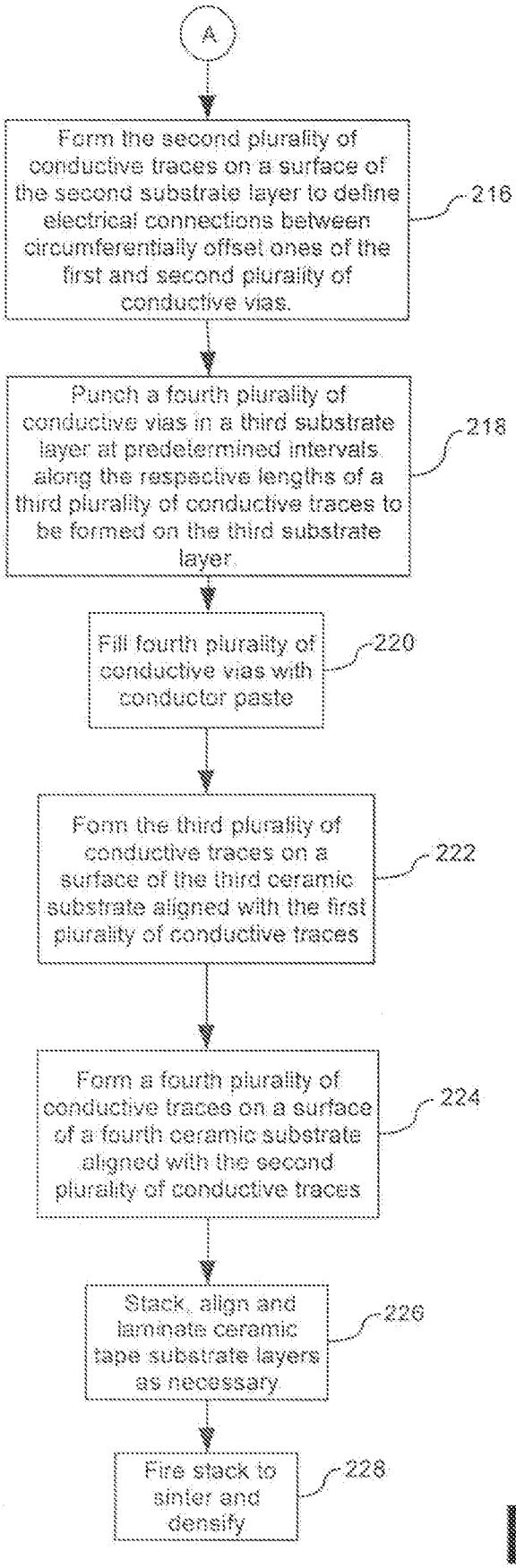
Figure 3:
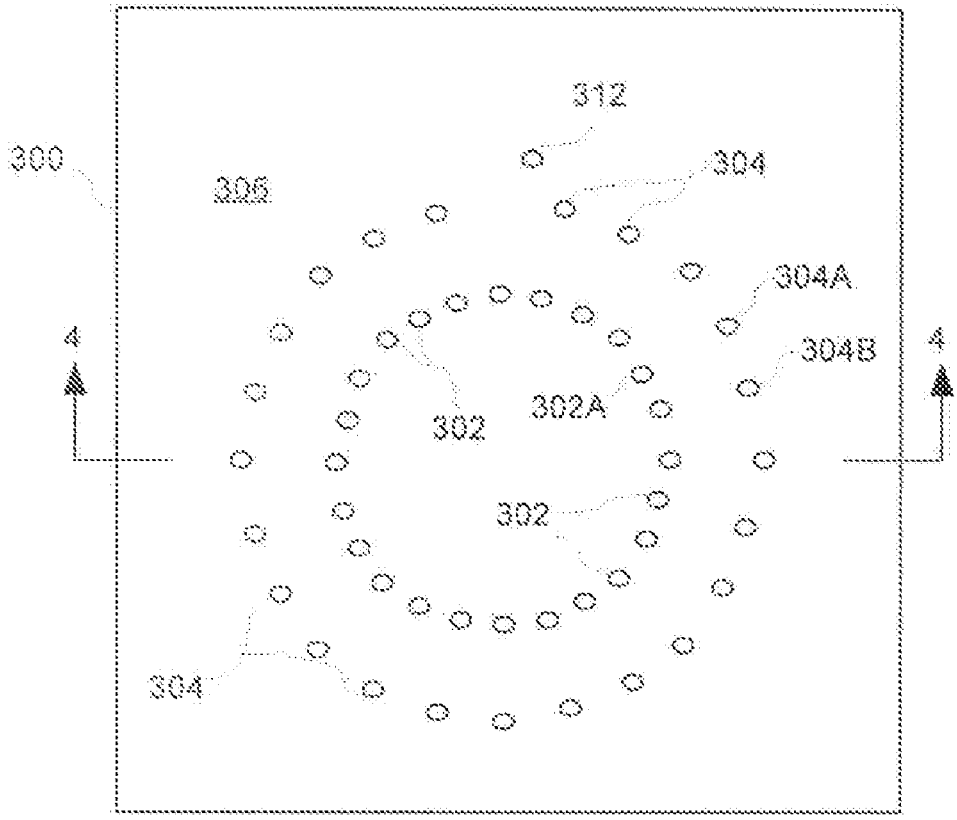
FIG. 3 is a top view of a ceramic substrate layer with vias formed therein that is useful for understanding the invention.
Figure 4:
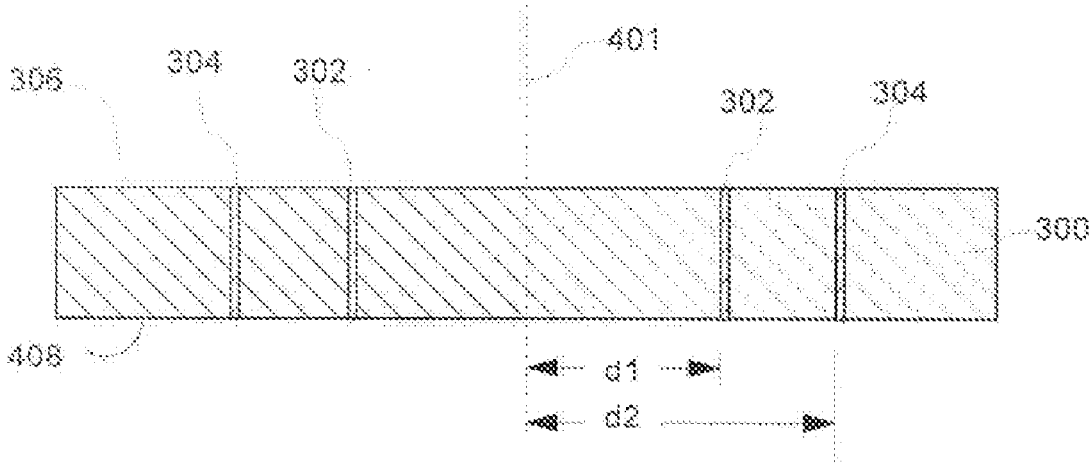
FIG. 4 is a cross-sectional view of the ceramic substrate layer of FIG. 3, taken along line 4-4.

A method for manufacturing a toroidal inductor having the form shown in FIG. 1 shall now be described in the flowchart in FIGS. 2A and 2B and with reference to FIGS. 1 and 3-19. Referring now to FIGS. 3 and 4, the method can begin with step 202 by forming a suitably sized piece of an unfired ceramic substrate layer 300. The ceramic substrate layer 300 can be any of a variety of commercially available glass ceramic substrates designed to be calcined at 800° C. to 1,050° C. This class of materials is commonly referred to as low-temperature co-fired ceramics (LTCC). Such LTCC materials have a number of advantages that make them especially useful as substrates for RF systems. For example, low temperature 951 co-fire Green Tape™ from Dupont® is Au and Ag compatible, and it has a thermal coefficient of expansion (TCE) and relative strength that are suitable for many applications. Other similar types of ceramic tapes can also be used. The size of the ceramic tape can be determined by a variety of factors depending upon the particular application. For example, if the toroidal inductor is to form part of a larger RF circuit, the ceramic tape can be sized to accommodate the RF circuit in which the toroidal inductor forms a component.

A first plurality of conductive vias 302 and a via 312 can be formed in the unfired ceramic substrate layer 300. This step can be performed using conventional techniques. For example, vias can be formed by punching, laser cutting, or etching holes in the unfired ceramic substrate layer 300. As shown in FIGS. 3 and 4, the first plurality of conductive vias 302 can be radially spaced a first distance d1 from a central axis 401 so as to defined an inner circumference of a toroidal inductor. In step 206, a second plurality of conductive vias 304 can be similarly formed radially spaced a second distance d2 about the central axis 401 so as to define an outer circumference. As shown in FIG. 4, the vias can extend substantially between opposing surfaces 306, 408 of the ceramic substrate layer 300. Each conductive via 302 can be positioned radially adjacent to a conductive via 304.

In general, the term "radially adjacent" means that two vias that are approximately radially aligned relative to central axis 401 and positioned adjacent to each other. Vias 302A and 304A are examples of radially adjacent vias. However, it should be noted that radially adjacent conductive vias, as that term is used herein, are not necessarily precisely aligned radially. Such radially adjacent vias can also include vias that are offset circumferentially from one another to some degree. In contrast, vias 302A and 304B represent circumferentially offset vias. As can be seen in FIG. 3, circumferentially offset vias are not aligned radially. In step 208, the via holes of the first and second pluralities of conductive vias 302, 304 are filled with conductive paste or any other suitable conductive element.

Figure 5:
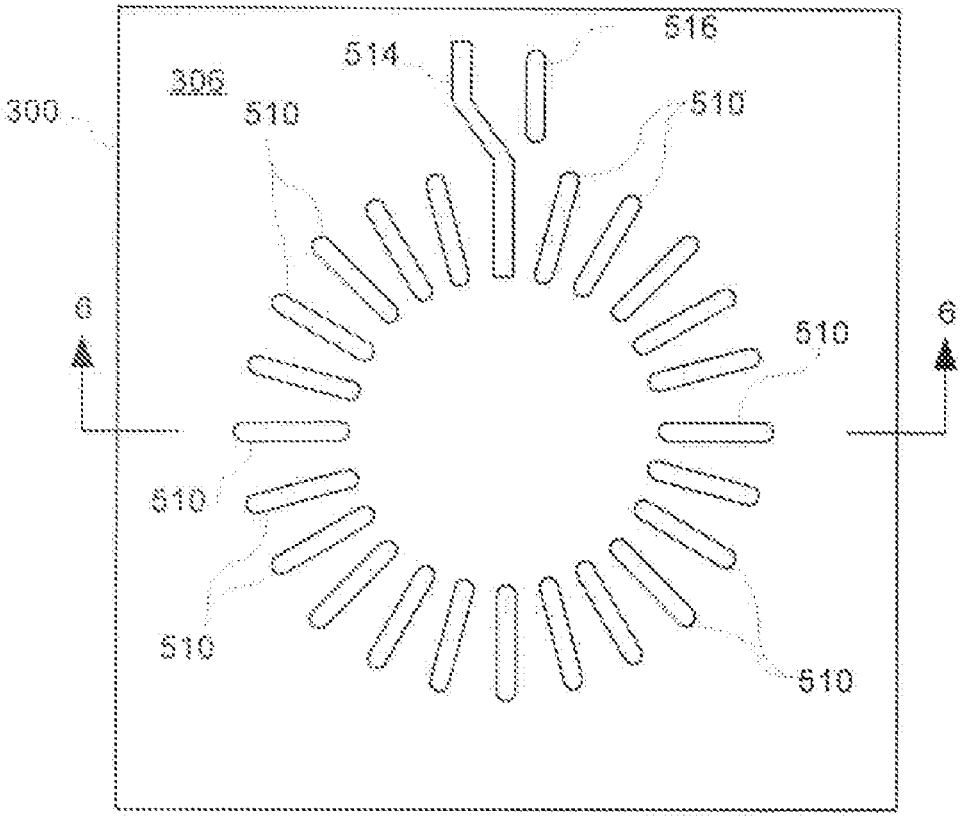
FIG. 5 is a top view of the ceramic substrate layer in FIG. 3 after the application of a pattern of conductive traces.
Figure 6:
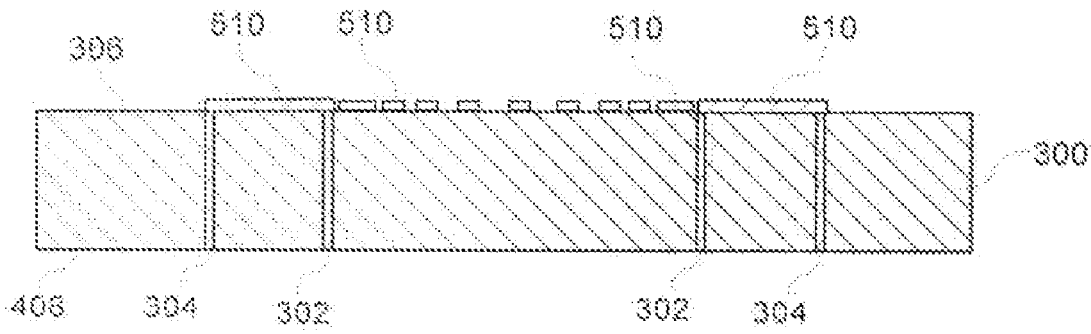
FIG. 6 is a cross-sectional view of the ceramic substrate layer of FIG. 5, taken along line 6-6.

Referring now to FIGS. 5 and 6, the process can continue in step 210 by disposing a first plurality of conductive traces 510 on ceramic substrate layer 300. The first plurality of conductive traces 510 on surface 306 form electrical connections between respective ones of the first plurality of conductive vias and second plurality of conductive vias that are substantially radially adjacent, as defined earlier. Moreover, additional conductive traces 514 and 516 can also be added to facilitate in the formation of electrical terminals. The conductive traces 510 can be formed using conventional PCB methods which are known to the skilled artisan, such as thick film screen printing, photoengraving, and PCB milling.

Figure 7:
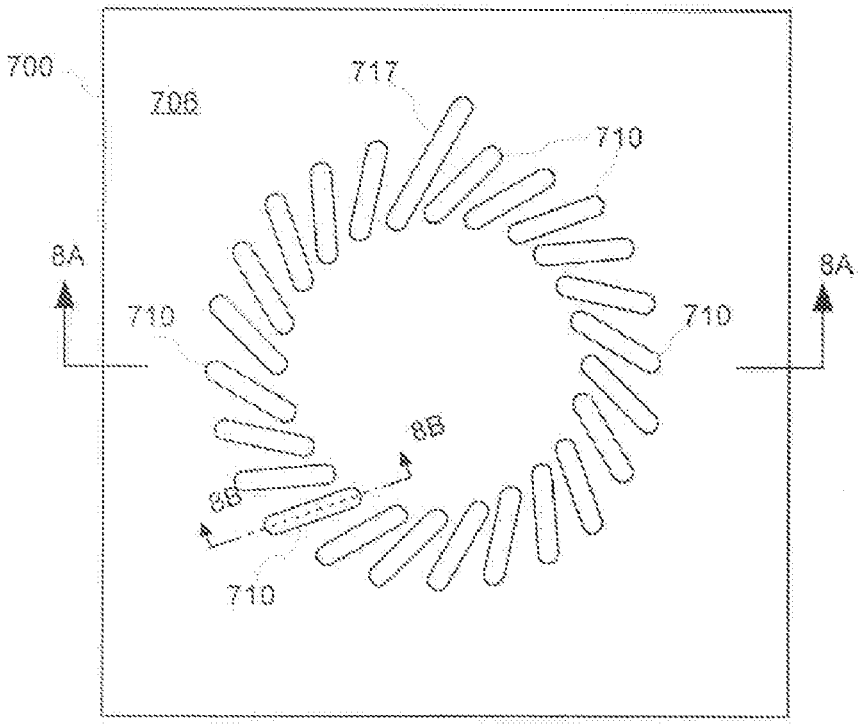
FIG. 7 is a top view of a second ceramic substrate layer that is useful for understanding the invention.
Figure 8A:
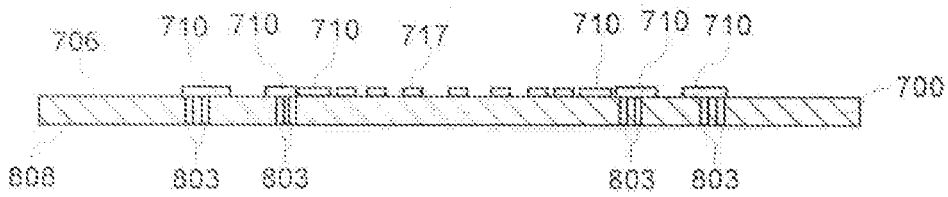
FIG. 8A is a cross-sectional view of the second ceramic substrate layer of FIG. 7, taken along line 8A-8A.
Figure 8B:
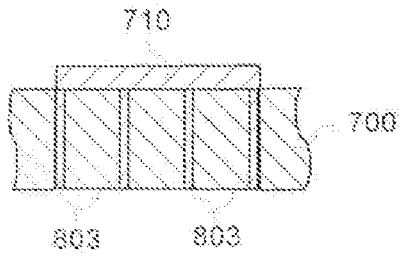
FIG. 8B is a partial expanded cross-sectional view of the second ceramic substrate layer of FIG. 7, taken along the line 8B-8B.
Figure 9:
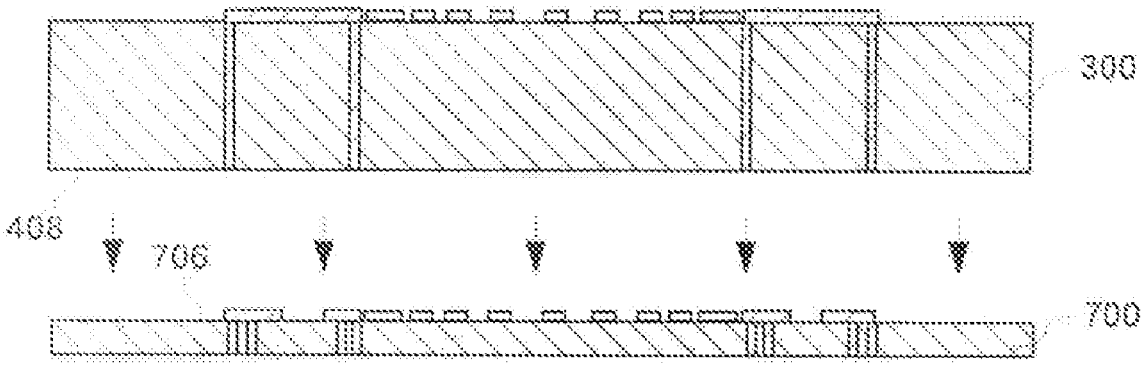
FIG. 9 is a cross-sectional view showing the first ceramic substrate layer being positioned on top of the second ceramic substrate layer.
Figure 10:
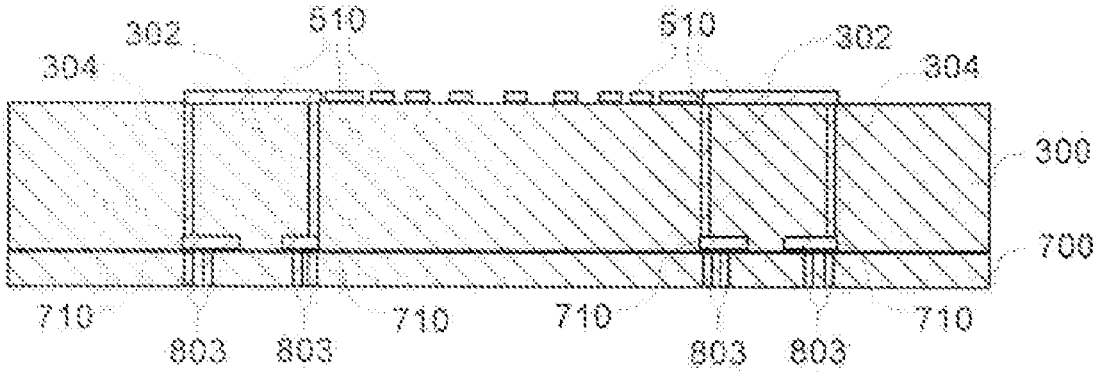
FIG. 10 is a cross-sectional view of the first and second ceramic substrate layers in a stacked configuration that is useful for understanding the invention.

Referring now to FIGS. 7, 8A, and 8B, the process continues by forming a second ceramic substrate layer 700. In step 212, a third plurality of conductive vias 803 are formed at predetermined intervals through the second ceramic substrate layer 700. The third plurality of vias 803 is located within a predetermined area which corresponds to each of the respective lengths of second conductive traces 710 (discussed below). This concept is best understood by referring to FIG. 8B. As shown in FIG. 8B, each trace 710 has the third plurality of vias 803 positioned at locations along the length of the trace 710 and at opposing ends of the trace 710. In step 214, the third plurality of conductive vias 803 are filled with conductive paste or any other suitable conductive element. In step 216, a second plurality of conductive traces 710 is provided on surface 706 of the second substrate layer 700. Moreover, additional conductive trace 717 can also be added to facilitate in the formation of electrical terminals. The second plurality of conductive traces 710 is arranged so that when the first and second ceramic substrate layers 300, 700 are aligned and stacked as shown in FIGS. 9 and 10, the trances 710 on surface 706 will provide an electrical connection between circumferentially offset ones of the first and second pluralities of conductive vias 302, 304.

Figure 11:
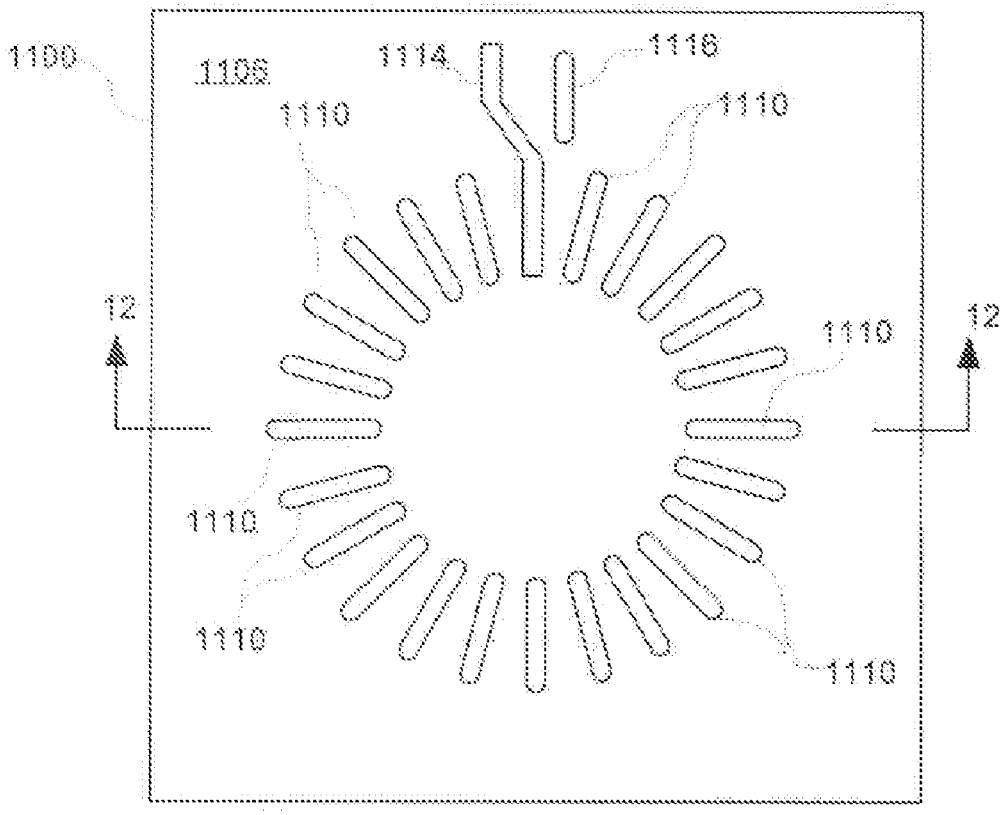
FIG. 11 is a top view of a third ceramic substrate layer that is useful for understanding the invention.
Figure 12:
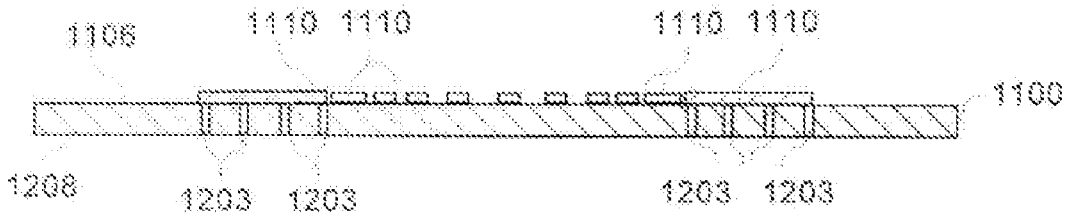
FIG. 12 is a cross-sectional view of the third ceramic substrate layer of FIG. 11, taken along line 12-12.

Referring now to FIGS. 11 and 12, the process continues by forming a third ceramic substrate layer 1100. In step 218, a fourth plurality of conductive vias 1203 are formed at predetermined intervals through the third ceramic substrate layer 1100. The hole locations are defined within the respective lengths of third conductive traces 1110 (discussed below). In step 220, the fourth plurality of conductive vias 1203 are filled with conductive paste or any other suitable conductive element. In step 222, the third plurality of conductive traces 1110 is provided on surface 1106 of the third substrate layer 1100. Moreover, additional conductive traces 1114, 1116 can also be added to facilitate in the formation of electrical terminals.

Figure 13:
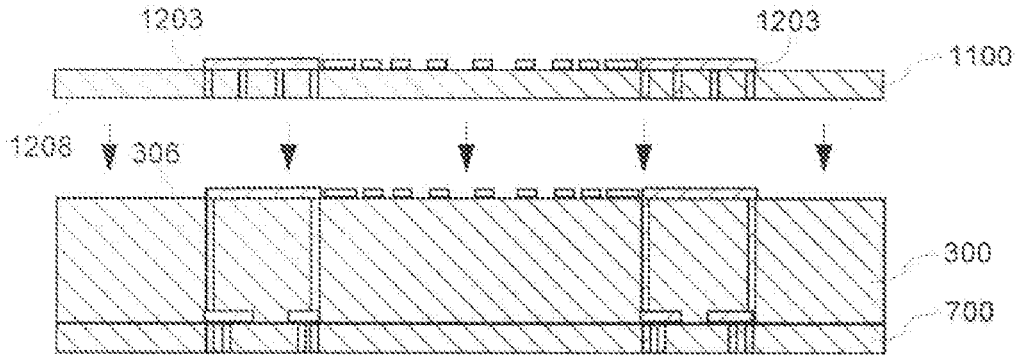
FIG. 13 is a cross-sectional view showing the third ceramic substrate layer being positioned on top of the first and second ceramic substrate layers.
Figure 14:
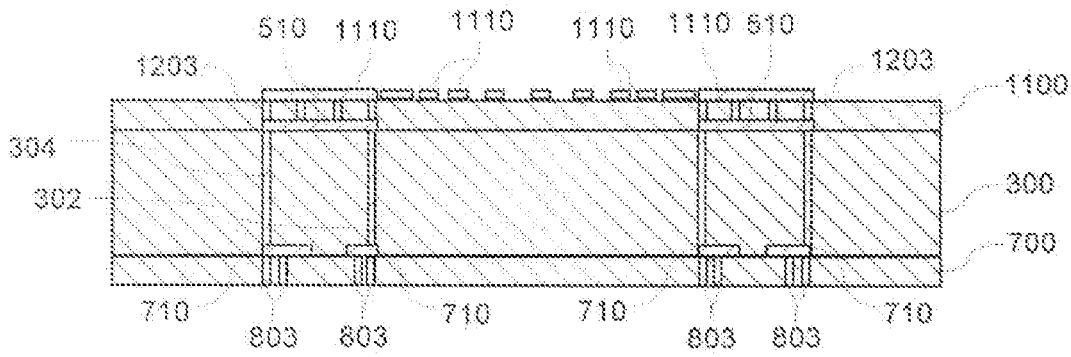
FIG. 14 is a cross-sectional view of the first, second and third ceramic substrate layers in a stacked configuration that is useful for understanding the invention.

The third plurality of conductive traces 1110 is arranged so that when the ceramic substrate layers 300 and 1100 are aligned and stacked as shown in FIGS. 13 and 14, the traces 1110 on surface 1106 and the conductive traces 510 on surface 306 define a plurality of elongated parallel conductors. The elongated parallel conductors are aligned with each other, spaced apart and electrically connected by conductive links defined by the fourth plurality of conductive vias 1203.

Figure 15:
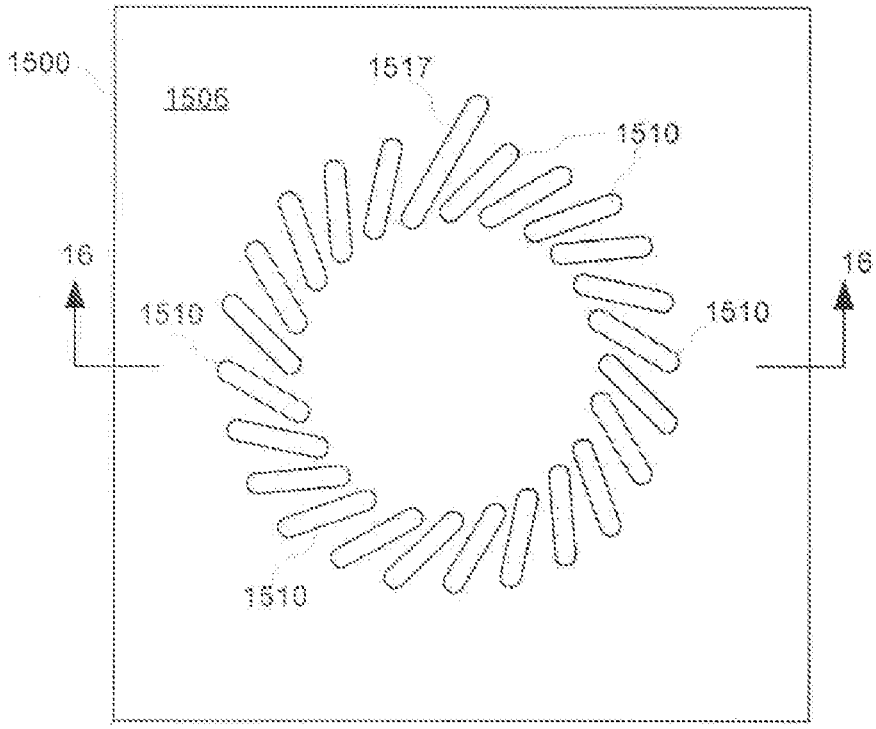
FIG. 15 is a top view of a fourth ceramic substrate layer that is useful for understanding the invention.
Figure 16:
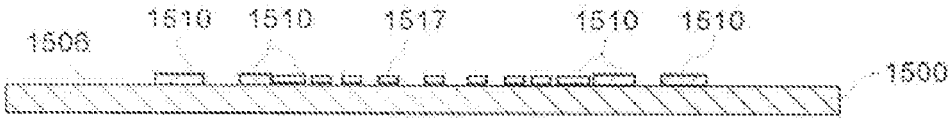
FIG. 16 is a cross-sectional view of the fourth ceramic substrate layer of FIG. 15, taken along the line 16-16.

Referring now to FIGS. 15 and 16, the process continues by forming a fourth ceramic substrate layer 1500. In step 224, a fourth plurality of conductive traces 1510 is provided on surface 1506 of the fourth substrate layer 1500. The fourth plurality of conductive traces 1510 are arranged in the same manner as the second plurality of conductive traces 710. Moreover, additional conductive trace 1517 can also be added to facilitate in the formation of electrical terminals.

Figure 17:
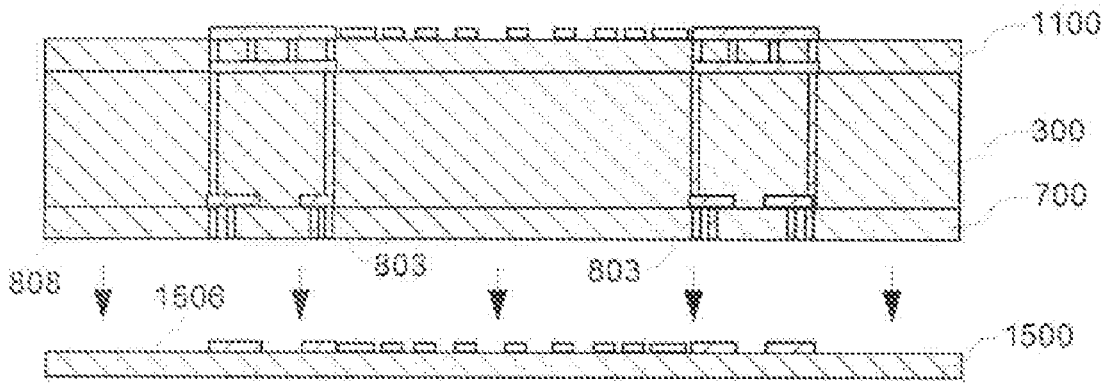
FIG. 17 is a cross-sectional view showing the fourth substrate layer being positioned underneath the first, second, and third ceramic substrate layers.
Figure 18:
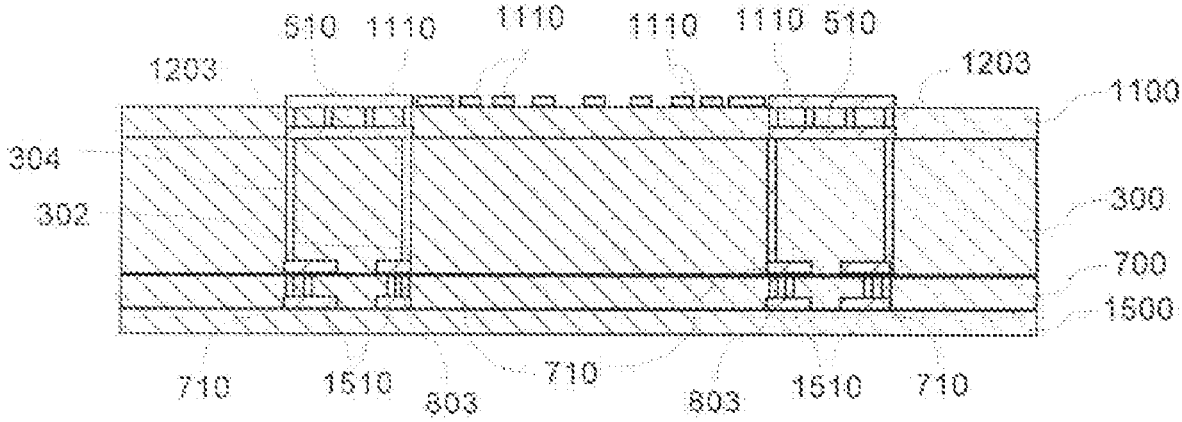
FIG. 18 is a cross-sectional view of the first, second, third, and fourth ceramic substrate layers in a stacked configuration that is useful for understanding the invention.

The fourth plurality of conductive traces 1510 is arranged so that when the ceramic substrate layers 700 and 1500 are aligned and stacked as shown in FIGS. 17 and 18, the traces 710 on surface 706 and the conductive traces 1510 on surface 1506 define a plurality of elongated parallel conductors. The elongated parallel conductors are aligned with each other, spaced apart, and electrically connected by conductive links defined by the fourth plurality of conductive vias 1203. The combination of elongated parallel conductors and conductive links serves to lower the direct current resistance in the system by increasing the effective cross-sectional area of the traces, hence improving the quality factor (Q) of the inductor. For example, in testing using standard DCR measuring instruments, the improved toroidal inductor design had a lower DCR value as compared to convectional toroidal inductors. Specifically, the DCR value was reduced by nearly one-half.

Figure 19:
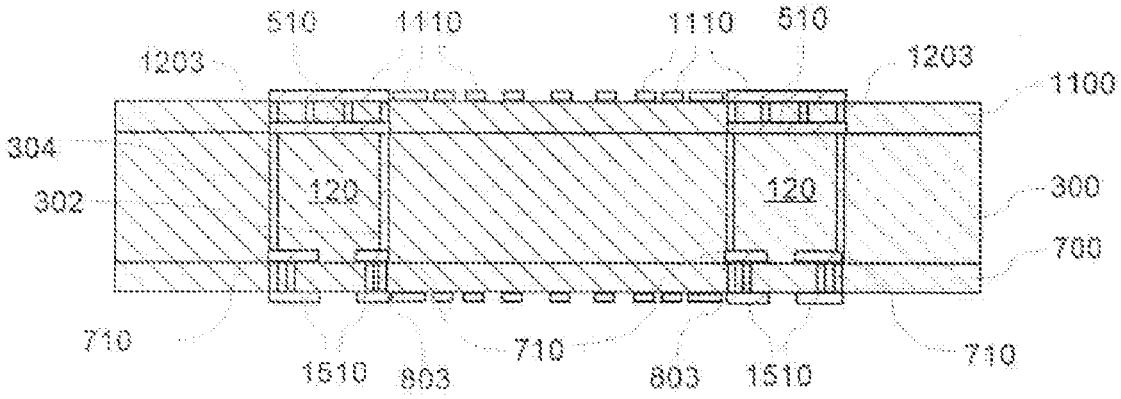
FIG. 19 is a cross-sectional view of a second alternative embodiment of the toroidal inductor shown in FIG. 18.

The conductive traces 510, 710, 1110, and 1510 can be formed by any suitable conductive film, paste, or ink that is compatible with the co-firing process for the selected LTCC material. Such materials are commercially available from a variety of sources. Further, it should be noted that for purposes of consistency with standard LTCC processing, each of the ceramic substrate layers shown in FIGS. 6, 8A, 12, and 16 contain conductive traces disposed on one side of each ceramic substrate layer only. However, the invention is not so limited. Those skilled in the art will appreciate that it is possible for the conductive traces to instead be disposed on opposing sides of a single layer of ceramic tape. Such alternative arrangements are intended to be within the scope of the invention. For example, such an alternative arrangement is shown in FIG. 19, where structure common to FIG. 18 is identified using like reference numerals. FIG. 19 shows second ceramic substrate layer 700, which includes conductive traces 710 and 1510 disposed on opposing sides. In step 226, the various LTCC layers 300, 700, 1100, and 1500 can be stacked and aligned with one another, as well as laminated by utilizing conventional processing techniques.

In their stacked configuration shown in FIG. 18, and conductive vias 302, 304, 803, 1203 and the conductive traces 510, 710, 1110, and 1510 in FIG. 18 together define a three dimensional conductive toroidal coil 100, which is best illustrated by the schematic representation in FIG. 1. In particular, FIG. 1 is useful for understanding the toroidal coil structure of the inventive arrangements. In this regard, it should be understood that the invention herein is not limited to the precise arrangement or pattern of vias 302, 304, 803, 1203 and traces 510, 710, 1110, 1510 illustrated in FIG. 18. Instead, any pattern, geometry, and number of vias and traces formed in the ceramic substrate layer can be used provided that it generally results in a substantially toroidal coil arrangement of the kind similar to that illustrated in FIG. 1.

In FIGS. 1 and 3-19 there is shown a toroidal coil in which the parallel conductive traces are comprised or only two elongated parallel conductors 104, 105. It should be understood, however, that the invention is not limited in this regard. Three or more parallel elongated conductors can also be used, with each elongated parallel conductor conductively linked with an adjacent layer by means of a plurality of conductive links disposed along the elongated length of each elongated parallel conductor.

Referring back to FIGS. 3, 5, 7, and 11, the combination of additional conductive vias 312 and additional conductive traces 514, 516, 717, 1114, 1116, and 1517 can be provided to define a set of electrical contacts for the toroidal inductor. Once all of the vias and traces are completed, the ceramic substrate layers, vias and traces can be fired together in step 228 in accordance with a temperature and time appropriate for the particular type of ceramic tape to sinter and densify.

While the preferred embodiments of the invention have been illustrated and described, it will be clear that the invention is not so limited. Numerous modifications, changes, variations, substitutions and equivalents will occur to those skilled in that art without departing from the spirit and scope of the present invention as described in the claims.

We claim:

1. An inductor, comprising:

a coil formed from an elongated conductor extending around a core material and defining a plurality of turns;

said elongated conductor comprised of at least one coil segment of a first type, each said coil segment of said first type comprised of a plurality of elongated parallel conductors spaced apart and electrically connected by conductive links at predetermined intervals along their respective lengths.

2. The inductor according to claim 1, wherein said elongated conductor is further comprised of at least one coil segment of a second type, said coil segment of said second type formed of a single conductor.

3. The inductor according to claim 2, wherein said coil segment of said first type and said coil segment of said second type are arranged in a series configuration to form said elongated conductor.

4. The inductor according to claim 3, wherein said elongated conductor is comprised of a plurality of said coil segments of said first type and a plurality of said coil segments of said second type, each said coil segment of said second type defining a series electrical connection between coil segments of said first type.

5. The inductor according to claim 2, wherein each said single conductor comprising said coil segment of said second type is comprised of a conductive via formed in a substrate.

6. The inductor according to claim 1, wherein each of said elongated parallel conductors is comprised of a conductive trace disposed on a surface of a substrate.

7. The inductor according to claim 1 wherein said conductive links are formed from vias defined in a substrate.

8. An inductor, comprising:

a coil formed from an elongated conductor extending around a core material and defining a plurality of turns;

said elongated conductor comprised of a plurality of coil segments arranged in an alternating pattern of a first type segment and a second type segment, said first type segment comprising a plurality of parallel conductors spaced apart and electrically connected at predetermined intervals along a length of said plurality of parallel conductors and said second type segment comprising a single elongated conductor.

9. The inductor according to claim 8, wherein said second type segments are comprised of conductive vias formed in a substrate.

10. The inductor according to claim 8, wherein each said parallel conductor is comprised of a conductive trace disposed on a surface of a substrate, and said conductive traces are connected at said predetermined intervals by at least one conductive via.

11. A method for forming an inductor, comprising:

forming a coil from an elongated conductor extending around a core material to define a plurality of turns;

forming said elongated conductor to include at least one coil segment of a first type comprised of a plurality of elongated parallel conductors spaced apart; and electrically connecting said elongated parallel conductors by means of conductive links spaced at predetermined intervals along a length of said plurality of elongated parallel conductors.

12. The method according to claim 11, further comprising forming said elongated conductor of at least one coil segment of a second type, said coil segment of said second type formed of a single conductor.

13. The method according to claim 12, further comprising arranging said at least one coil segment of said first type and said at least one coil segment of said second type in a series configuration to form said elongated conductor.

14. The method according to claim 13, further comprising forming with said at least one coil segment of said second type a series electrical connection between a plurality of said coil segments of said first type.

15. The method according to claim 12, further comprising forming each said coil segment of said second type as a conductive via formed in a substrate.

16. The method according to claim 11, further comprising forming each of said parallel conductors as a conductive trace disposed on a surface of a substrate.

17. The method according to claim 11 further comprising forming said conductive links from vias defined in a substrate.

18. A method for forming an inductor, comprising:

forming an elongated conductor which extends a plurality of turns around a core material to define a coil;

selecting said elongated conductor to include a plurality of coil segments arranged in an alternating pattern of a first type segment and a second type segment;

selecting said first type segment to include a plurality of parallel conductors spaced apart and electrically connected to each other at predetermined intervals along a length of said plurality of parallel conductors and said second type segment to include a single conductor.

19. The method according to claim 18, further comprising forming said second type segments as conductive vias disposed within a substrate.

20. The method according to claim 19, further comprising forming each said parallel conductor as a conductive trace disposed on a surface of a substrate, and connecting said conductive traces at said predetermined intervals by at least one conductive via.

* * * * *